United States Patent [19]

Ratliff

[11] 4,425,712

[45] Jan. 17, 1984

[54] WOMAN'S OUTER GARMENT AND PATTERN THEREFOR

[76] Inventor: Willa D. L. Ratliff, 2838 Linhaven Dr., Mesquite, Tex. 75150

[21] Appl. No.: 94,272

[22] Filed: Nov. 14, 1979

Related U.S. Application Data

[62] Division of Ser. No. 847,269, Oct. 31, 1977, abandoned.

[51] Int. Cl.[3] ..... A41H 3/00

[52] U.S. Cl. ..... 33/12

[58] Field of Search ..... 33/12, 17 R

[56] References Cited

FOREIGN PATENT DOCUMENTS 111671 9/1968 Denmark ..... 33/17 R

*Primary Examiner*—Charles E. Phillips

*Attorney, Agent, or Firm*—Richards, Harris & Medlock

[57] ABSTRACT

A woman's outer garment made from a single piece of fabric material. The garment has both the bodice and the lower garment portion integrally formed from a single piece of material. The bodice has a neck opening formed therein and a back panel with ties to be positioned around the wearer in various arrangements. The lower portion of the garment can be configured to provide either pants or a skirt.

A pattern is also disclosed for a woman's outer garment to be made from one continuous piece of fabric which utilizes a sheet of pattern material of a generally rectangular shape having front and backside edges and upper and lower end edges. The pattern has a first cut line for defining a pair of ties for the bodice portion which are to be wrapped around the wearer and tied. A second cut line indicated on the sheet sets the length of the neckline. A third, irregular cut line defines the arm opening portions of the garment. The disclosed pattern provides a cutout of a garment which, upon being sewn together in the lower portions, forms a skirt or pants, and provides an entirely one-piece garment formed from a single piece of fabric.

12 Claims, 12 Drawing Figures

WOMAN'S OUTER GARMENT AND PATTERN THEREFOR

This is a division of application Ser. No. 847,269, filed Oct. 31, 1977, now abandoned.

BACKGROUND OF THE INVENTION

The instant invention relates to women's outer garments and patterns for making the same. More particularly, the instant invention relates to an outer garment, and a pattern for the garment, having an upper bodice portion and a lower portion to be formed as a skirt or pants, with the entire garment being formed from a single, continuous piece of fabric.

In the area of women's fashions, jumpsuits or dresses having ties on the bodice that can be wrapped into various configurations around the wearer's body and tied have become a popular item of sports, casual or formal wear.

Representative of the patterns available for such garments is MCCALL'S Carefree Pattern No. 5529 available from the McCall Pattern Company, 230 Park Avenue, New York, New York 10017. This pattern is for a dress or top and pants in which a pair of ties are formed on the bodice portion to be wrapped around the wearer's body in various configurations.

Patterns of this type have heretofore required that separate pieces of the garment be cut from a piece of fabric, and then be sewn together to assemble the entire garment. Accordingly, great care is required in accurately cutting the garment pieces. In addition, a substantial amount of time and skill is required to sew the garment pieces together.

Accordingly, a pattern for making a woman's outer garment, such as a jumpsuit or dress, that can be cut from a single, continuous piece of fabric, with only prescribed sections being sewn together to form the complete garment, would be most desirable.

SUMMARY OF THE INVENTION

In accordance with the present invention, a woman's outer garment is provided, which is made from a single piece of fabric material. The garment comprises a garment piece having first and second mirror-image halves formed symmetrically about a line extending across the garment piece at the midpoint location between opposing ends of the garment piece. The garment piece halves constitute joined right and left side sections which, upon sewing of selected sections of each half, define an upper bodice portion and a lower garment portion.

In accordance with the general concept of this invention, a particular embodiment of the invention can be that of a jumpsuit comprising an upper bodice portion and a lower garment portion formed as pant legs. In such an embodiment, the bodice portion includes a panel section covering the wearer's back and a neckline opening defined in the front. The bodice portion can further be provided with ties formed integrally with the back panel that are positioned around the wearer in various arrangements.

Further in accordance with the present invention, there is also provided a pattern for a woman's outer garment to be made from one continuous piece of fabric. The pattern comprises a sheet of pattern material, such as tissue paper or the like, of a generally rectangular shape having front and backside edges and upper and lower end edges.

The rectangular sheet has a first cut line indicated thereon for defining the ties portion of the garment. A second cut line is indicated on the sheet to define the length of the neckline of the garment. A third, irregular cut line is indicated on the sheet to define the arm openings of the garment.

The pattern of the present invention provides, upon cutting along the indicated cut lines, a garment having a bodice portion with an open neckline down the front of predetermined length and ties to be wrapped around the wearer in various arrangements.

In addition, the present invention provides a pattern for a woman's outer garment having, in addition to the ties, a bodice providing substantially complete coverage of the wearer's back.

These and other features of the present invention will be more fully appreciated from reference to the detailed description that follows.

DESCRIPTION OF THE DRAWINGS

A more complete appreciation of the invention may be had by reference to the accompanying drawings, illustrating an embodiment thereof to be described in detail, wherein.

DETAILED DESCRIPTION

Figure 1:
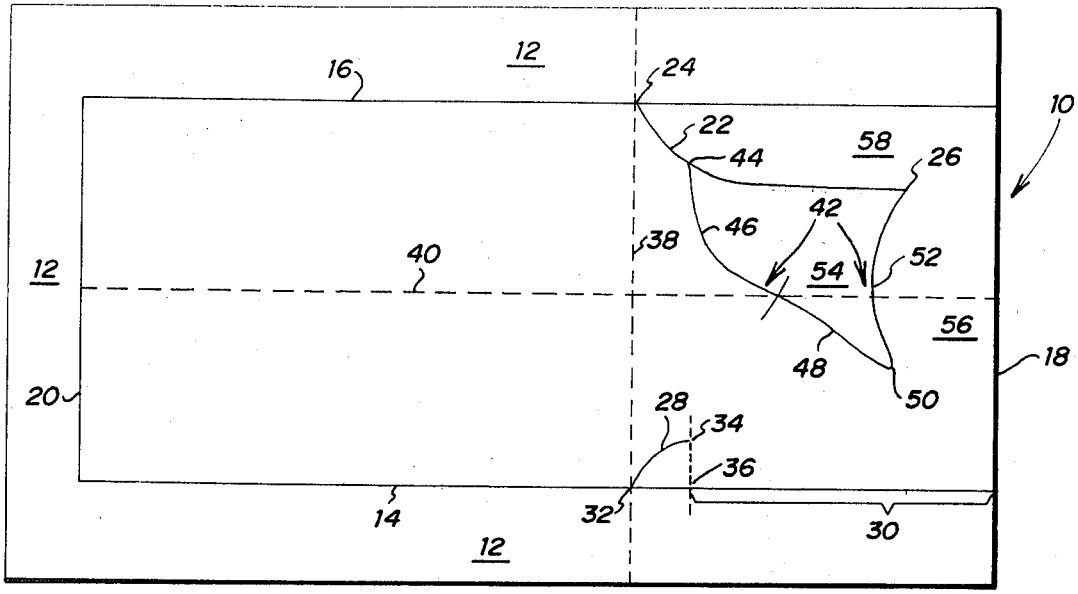
FIG. 1 is a plan view of a pattern in accordance with the present invention laid upon a single piece of folded-over fabric.

With reference to FIG. 1, there is shown a pattern 10 in accordance with the present invention comprising a sheet 11 of pattern material, such as tissue paper or the like. Sheet 11 is of a generally rectangular shape having front and backside edges 14 and 16, respectively, and upper and lower end edges 18 and 20, respectively.

Fabric 12 is one continuous piece that is folded over in order to form duplicate halves. Sheet 11 is arranged on fabric 12 such that the upper end edge 18 is in alignment with the folded edge of fabric 12.

A first cut line 22 is indicated on the sheet for defining the ties portion of the garment. Cut line 22 begins at a point 24 on the backside edge 16 of the sheet and proceeds inwardly therefrom before turning upward and extending parallel with the backside edge to a predetermined location at point 26 before terminating. As shown, cut line 22 proceeds inwardly from backside edge 16 for a distance and gradually transitions in an upwardly arcuate manner into a straight line portion that extends substantially parallel with backside edge 16. The location of termination point 26 defines the size of the garment.

A second cut line 28 is indicated on the sheet to define the length of the neckline 30. Cut line 29 begins at a point 32 on the front side edge 14 of the sheet and proceeds inwardly therefrom, turning inwardly and extending parallel with the front side edge to a predetermined location at point 34. It will be appreciated that the distance of cut line 28, as measured along the front side edge 14 between point 32 and point 36 will determine the width of the collar portion around the periphery of neckline 30 of the garment.

As will be noted, point 24 on backside edge 16 and point 32 on front edge 14 are at substantially corresponding longitudinal positions between the upper and lower end edges 18 and 20. An imaginary line 38 drawn across pattern 10 defines a dividing line between the bodice portion of the garment and the lower skirt or pants portion of the garment. Another imaginary line 40 extending longitudinally down the pattern between front and backside edges 14 and 16 corresponds to the outer seam of conventional pants and the like.

A third, irregular cut line 42 is indicated on the sheet to define the arm openings of the garment. Cut line 42 begins at a point 44 on first cut line 22 intermediate points 24 and 26. Cut line 42 terminates at the point of termination of the first cut line, point 26.

Cut line 42 includes a forwardly extending concave portion 46 that is followed by a forwardly extending convex portion 48 that terminates at a point 50 on the pattern. A convex portion 52 extending rearwardly from point 50 to point 26 completes the third, irregular cut line 42. It will be appreciated that upon completion of cutting of line 22 and cut line 42 a section 54 will be cut out of the material. The rounded portion at point 50 along cut line 42 corresponds to the top of the shoulder of the garment to be formed in pattern 10.

After fabric 12 has been cut as indicated along cut lines 22, 28 and 42, and along the front and backside edges 14 and 16 and lower edge 20, the remainder of the material can be discarded. The section of fabric 12 that is cut-out from the pattern and that is to be used is the actual garment piece 60 shown in FIG. 2.

Figure 2:
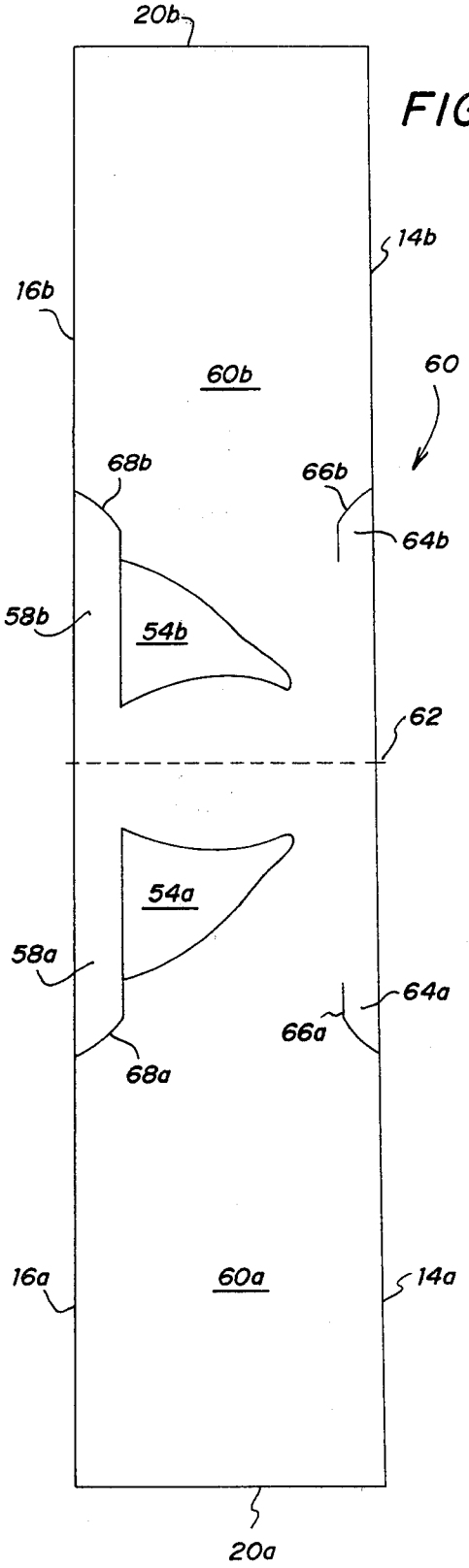
FIG. 2 shows the single piece of fabric of FIG. 1 after cutting in accordance with the pattern and in an unfolded condition.

Referring then to FIG. 2, garment piece 60 is shown unfolded. As the particular embodiment, represented by pattern 10, being described in the detailed description is that of a jumpsuit, it is necessary that the garment piece be relatively long. It will be understood, however, that should a dress be made, the end-to-end dimensions of garment piece 60 would be less. It would, of course, follow that if the garment to be made is to have short pant legs, the lengthwise dimension of garment piece 60 would be even less.

As shown in FIG. 2, the unfolded garment piece 60 is actually two joined mirror-image halves 60*a* and 60*b* of rectangular configuration. Garment piece half 60*a* has, in accordance with pattern 10 from which it was cut, front and backside edges 14*a* and 16*a* and lower edge 20*a*. Similarly, garment piece half 60*b* has front and backside edges 14*b* and 16*b* and lower edge 20*b*. Garment piece halves 60*a* and 60*b* also have a cutout section 54*a* and 54*b*, respectively. Cutouts 54*a* and 54*b*, though being mirror-images, are symmetrically placed with respect to a line 62 extending across garment piece 60 at the midpoint location between the opposing ends 20*a* and 29*b*. It will be recognized that the location of line 62 corresponds to the line along which original fabric piece 12 was folded during cutting.

Garment piece halves 60*a* and 60*b*, in addition to having their respective cutout sections 54*a* and 54*b*, also include ties 58*a* and 58*b*. The cut that was made in fabric 12 along cut line 22 on pattern 10 resulted in the forming of ties 58*a* and 58*b* and curved edges 68*a* and 68*b*. Again, ties 58*a* and 58*b* are symmetrical about line 62 and extend along the backside edges 16*a* and 16*b* of their respective garment piece halves.

On the front side edges 14*a* and 14*b* of garment piece halves 60*a* and 60*b*, flaps 64*a* and 64*b* are formed. The flaps are mirror-images of one another and were formed by the cutting of fabric 12 along cut line 28 of pattern 10. The forming of flaps 64*a* and 64*b* provides curved edges 66*a* and 66*b*.

Figure 3:
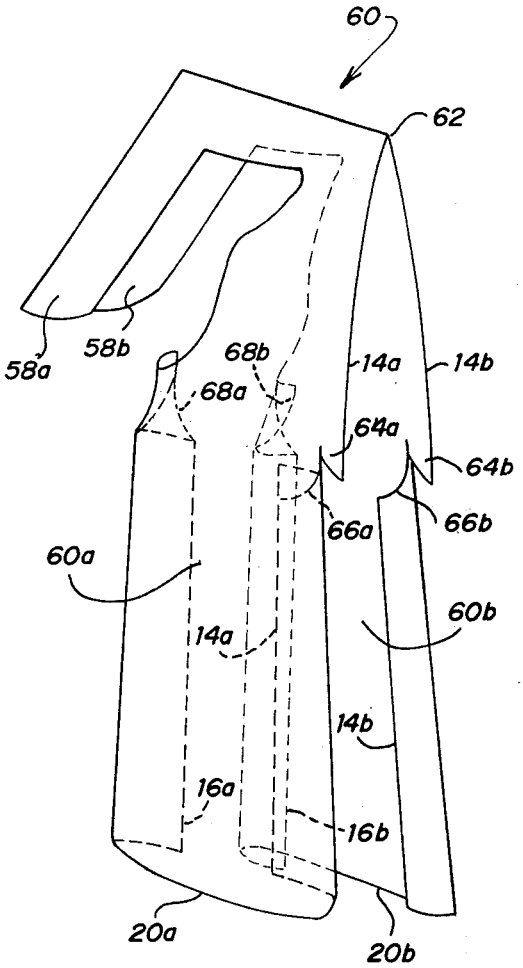
FIG. 3 illustrates the manner in which the various areas of the single piece of fabric shown in FIG. 2 are brought together to form a jumpsuit type garment.

Referring now to FIG. 3, garment piece 60 is shown in an upright orientation and partially folded along the imaginary line 62 to demonstrate that garment piece halves 60*a* and 60*b* may actually be visualized as right and left side sections of a garment formed therefrom. The illustration of garment piece 60 in FIG. 3 also has the front and backside edges of their respective half partially turned toward one another to assist in the visualizing of the garment piece as constituting joined right side and left side sections.

Figure 4:
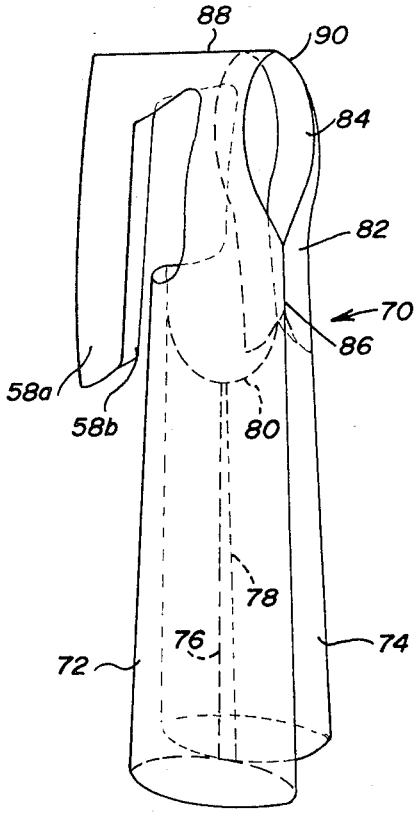
FIG. 4 shows the single piece of fabric illustrated in FIG. 3 after joining of the various areas by sewing to form a jumpsuit garment.

Turning now to FIG. 4, garment piece 60 is shown following the sewing together of selected edge areas thereof to form the finished jumpsuit 70. As will be appreciated when FIGS. 3 and 4 are viewed in conjunction, the pant legs 72 and 74 of garment 70 are formed from the lower portion of one of the garment piece halves. More specifically, pant leg 72 is formed by the sewing together of edges 14*a* and 16*a* along a seam 76, and pant leg 74 is formed by the sewing together of edges 14*b* and 16*b* along a seam 78.

It will be observed that the forming of pant leg 72 by sewing along seam 76 will bring together, at the top of seam 76, curved edge 66*a* and curved edge 68*a*. Similarly, forming of seam 78 will join curved edge 66*b* and curved edge 68*b*. The crotch line 80 of garment 70 is formed, and pant legs 72 and 74 are joined to complete the lower garment portion, by sewing together two curved lines, one being that formed by curved edges 66*a* and 68*a*, and the other formed by curved edges 66*b* and 68*b*.

The upper bodice portion 82 of garment 70 as shown has a neckline opening 84. From FIGS. 3 and 4, it can be understood that neckline 84 is formed in general from the upper portions of front side edges 14*a*, 14*b* that are between the symmetry line 62 and flaps 64*a* and 64*b*. To form neckline opening 84, the edges 14*a* and 14*b* are folded under and the garment piece sewn together along a seam 86 that extends down the front of bodice 82 to the start of the crotch line. Bodice portion 82 also includes a back panel portion 88 extending from the neckline edge 90 that defines opening 84. Ties 58*a* and 58*b* extend from back panel 88.

Figure 5:
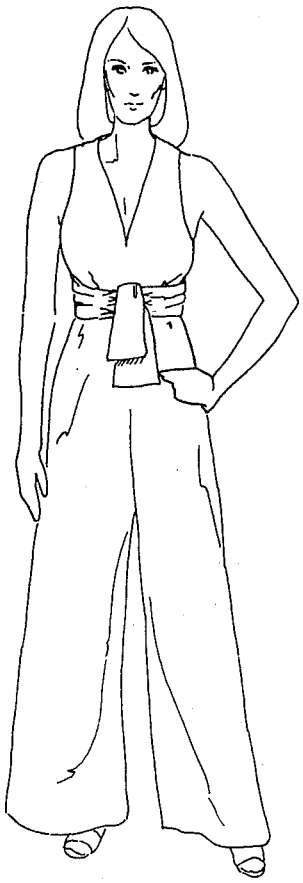
FIG. 5 illustrates the garment of FIG. 4 on a model to show details of the front portion of the garment.
Figure 6:
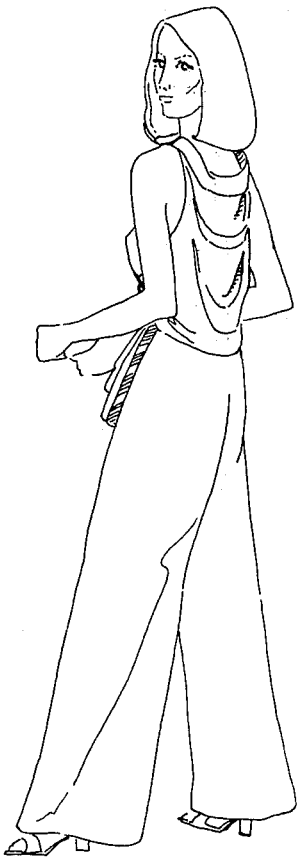
FIG. 6 illustrates the garment of FIG. 4 from the back.

The manner in which the bodice portion fits around a wearer and the look of the overall garment of the jumpsuit of this particular embodiment are illustrated in FIGS. 5 and 6, wherein a model is shown wearing garment 70. From FIGS. 5 and 6, it can be observed that a wearer's head fits through neckline opening and the back panel is pulled down over the wearer's back. The back panel is sufficiently large that it covers the wearer's back completely. The ties are pulled under the wearer's arms to pull the back panel down into position. The ties can be conveniently tied around the wearer's waist to hold the back panel in position.

The pattern of the present invention provides for the fabrication of a garment that may be varied in its manner of wear.

Figure 7A:
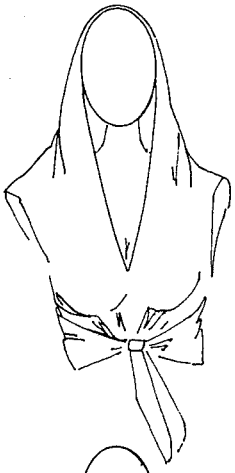
FIGS. 7A to 7F illustrate the various ways in which a garment made from the pattern of FIG. 1 can be worn.
Figure 7B:
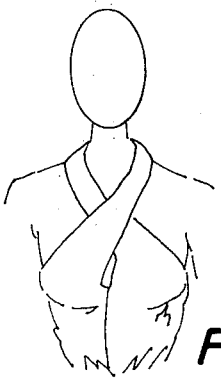
Figure 7C:
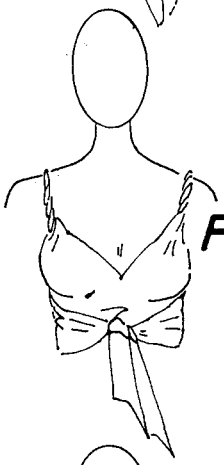
Figure 7D:
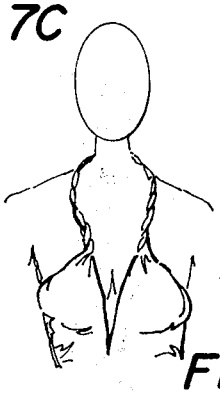
Figure 7E:
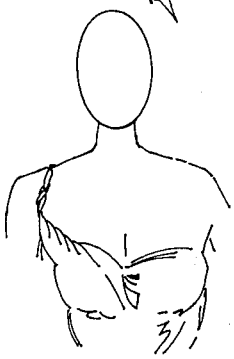
Figure 7F:
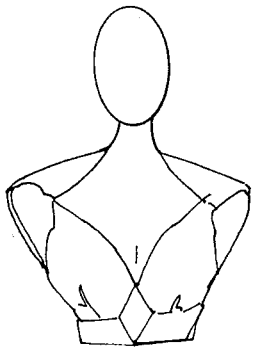

As shown in FIG. 7A, the back panel can be pulled upwardly and over the wearer's head to form a hood. Also, rather than simply providing ties that are positioned around the waist, as shown in FIGS. 7B through 7F, the back panel can be cut out to form a pair of very long ties and wrapped around the wearer in various other arrangements. In FIG. 7B, the ties are crossed and re-crossed in front and behind the neck. The ties can also be roped and brought straight up and over each shoulder, as shown in FIG. 7C, or the roped ties can be crossed behind the neck, as shown in FIG. 7D. Yet another arrangement is that of FIG. 7E, wherein the ties are roped together and brought over one shoulder. FIG. 7F illustrates how the back panel can be pulled outwardly at the sides to cover the wearer's shoulders. Also, in FIG. 7F, the neckline has been widened by folding an additional amount thereof under.

The foregoing description of the present invention has been made with reference to a particular embodiment, which is but one of many possible embodiments, for purposes of explanation and illustration. It is therefore to be understood that, within the scope of the appended claims, the concepts of the present invention can be utilized to make garments comprising but a single garment piece in forms other than as specifically described and shown.

What is claimed is:

1. A pattern for a garment to be made from a single garment piece cut from a piece of folded-over fabric material, which comprises:

a single sheet of pattern material of a generally rectangular shape to be laid over a folded-over piece of fabric material, said sheet defining joined right and left, mirror-image halves of a garment piece cut from a folded-over piece of fabric material, and having a cut line thereon for indicating an area to be cut out of the garment piece halves for arm openings.

2. The pattern of claim 1 wherein said sheet of pattern material has upper and lower end edges and front side and backside edges, with the upper end to be placed along the fold in the fabric material from which the garment piece is to be cut.

3. The pattern of claim 2 wherein a portion of the front side edge of the sheet defines the neckline of a garment to be made from the pattern.

4. The pattern of claim 2 wherein the upper edge of said sheet defines the back panel of the bodice portion of a garment to be made from the pattern.

5. The pattern of claim 2 wherein said sheet of pattern material further includes a cut line indicated thereon to define ties for a garment to be made from the pattern.

6. The pattern of claim 5 wherein the cut line defining the ties is indicated on said sheet adjacent the backside edge.

7. A pattern for a woman's outer garment to be made from one continuous piece of fabric folded to define two joined-together halves, which comprises:

a sheet of pattern material of a generally rectangular shape having front side and backside edges and upper and lower end edges, said sheet having, a first cut line for defining ties indicated thereon beginning at a point along the backside edge and proceeding inwardly therefrom through an upward arcuate transition to a second point from which said first cut line extends in a substantially straight line to a predetermined point of termination;

a second cut line for defining neckline length indicated thereon beginning at a point on the front side edge and proceeding inwardly therefrom through an upward arcuate transistion to a predetermined point of termination, and an irregular third cut line for defining arm openings indicated thereon beginning at a point along said first cut line and terminating at the point of termination of said first cut line.

8. The pattern of claim 7 wherein said irregular third cut line includes:

a forwardly extending concave segment followed by a forwardly extending convex segment, and a rearwardly extending convex segment.

9. The pattern of claim 7 wherein the upper end edge of the pattern sheet defines the back panel portion of the bodice of a garment made from the pattern.

10. The pattern of claim 7 wherein the upper portion of the front side edge of the sheet defines the collar of the bodice of a garment made from the pattern.

11. The pattern of claim 7 wherein the straight line portion of said first cut line between the arcuate transition portion and the point of termination extends parallel with the backside edge of the sheet.

12. The pattern of claim 7 wherein the location of the point of termination of said first cut lines defines the size of a garment made from the pattern.

* * * * *